US005649640A

United States Patent [19]

Hermann et al.

[11] Patent Number: 5,649,640

[45] Date of Patent: Jul. 22, 1997

[54] PALLET-TYPE STORAGE/TRANSPORT CONTAINER

[75] Inventors: Francis Hermann, Mittelbronn; Franck Dolvet, Phalsbourg, both of France

[73] Assignee: Sotralentz S.A., Drulingen, France

[21] Appl. No.: 553,851

[22] Filed: Nov. 6, 1995

[30] Foreign Application Priority Data

Nov. 10, 1994 [DE] Germany ..... 9417965 U

[51] Int. Cl.[6] ..... B65D 19/00

[52] U.S. Cl. ..... 220/403; 220/1.5; 220/410; 220/485

[58] Field of Search ..... 220/403, 401, 220/410, 1.5, 485

[56] References Cited

U.S. PATENT DOCUMENTS

| | | | |
|---|---|---|---|
| 2,903,126 | 9/1959 | Heath | 220/1.5 X |
| 4,909,387 | 3/1990 | Schutz | 220/1.5 X |
| 5,058,747 | 10/1991 | Decroix . | |
| 5,110,000 | 5/1992 | Nichols | 220/1.5 X |
| 5,358,137 | 10/1994 | Shuert et al. | 220/410 X |
| 5,447,250 | 9/1995 | Schutz | 220/410 X |

FOREIGN PATENT DOCUMENTS 3039635 7/1981 Germany .

*Primary Examiner*—Steven M. Pollard
*Attorney, Agent, or Firm*—Herbert Dubno; Andrew Wilford

[57] ABSTRACT

A storage/transport container has an annular and erect outer wall in the form of a gridwork of metal rods having a lower edge and provided at the edge with an annular metal stiffening rod. A wooden floor-forming pallet downwardly closes the wall, forms with the wall an outer vessel, and has a ground-engaging lower surface, an opposite and horizontal upper surface, and a pair of vertical and generally parallel and longitudinally extending side edges. A metallic brace bar transversely bridges the pallet between its side edges, lies on the upper surface of the pallet, forms at each side edge a downwardly open notch engaging downwardly over the stiffening rod and has at each edge a downwardly extending tab formed outside the respective seat with a horizontally throughgoing hole. Respective metallic clips engage through the holes and under the stiffening rod and screws engaged vertically through the brace bar and clips into the pallet secure same together. An inner vessel composed of flexible plastic material is enclosed by the outer wall and supported on the floor.

9 Claims, 4 Drawing Sheets

FIG. 3
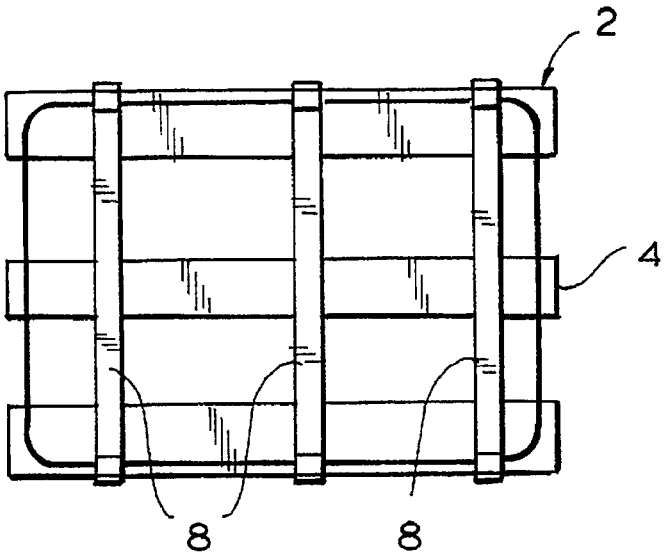
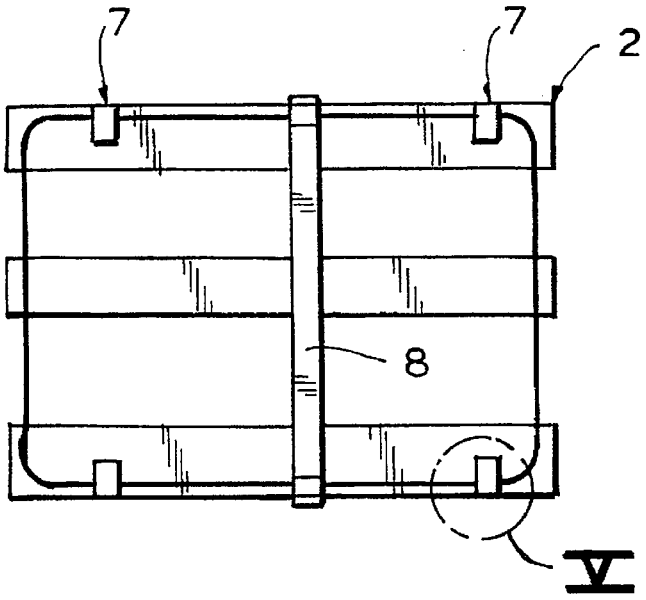
FIG. 4

FIG. 5
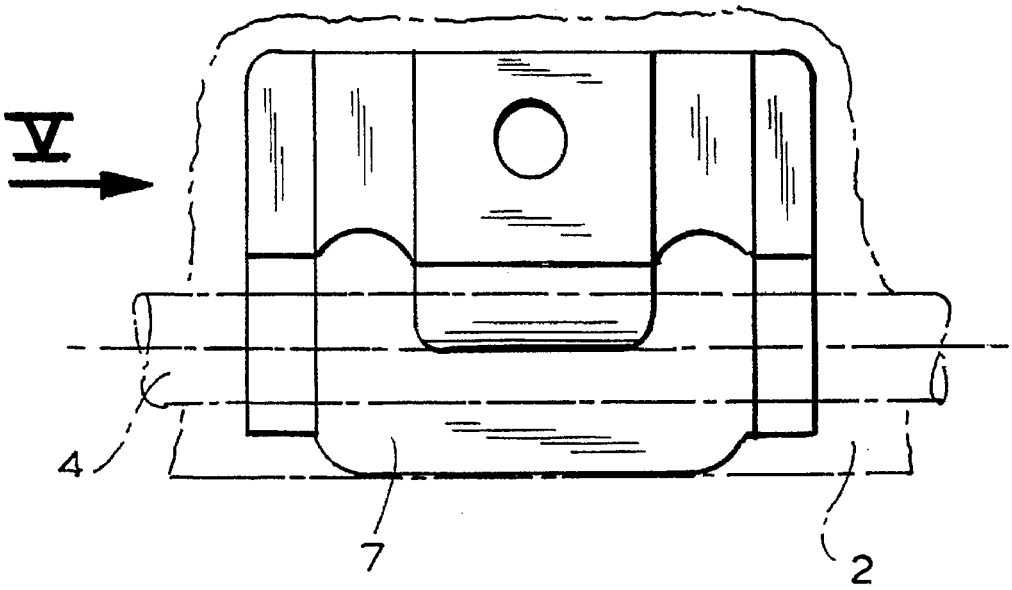
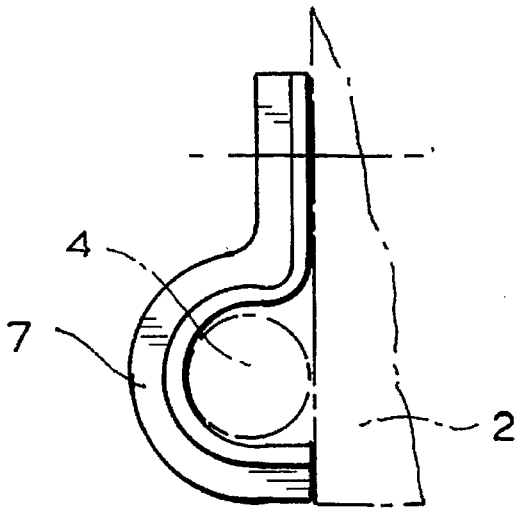
FIG. 6

PALLET-TYPE STORAGE/TRANSPORT CONTAINER

FIELD OF THE INVENTION

The present invention relates to a storage and transport container for bulk materials or liquids. More particularly this invention concerns such a container incorporating or carried on a pallet.

BACKGROUND OF THE INVENTION

In commonly owned U.S. Pat. No. 5,058,747 of Decroix and in German patent 3,039,635 of B. Cheval a container is described that has an annular and erect outer wall in the form of a gridwork of rods having a lower edge and provided at the edge with an annular stiffening rod and a pallet-like floor downwardly closing the wall, forming therewith an outer vessel, and provided with a plurality of wooden foot beams each having a ground-engaging lower surface, an upper surface, and a pair of ends. Respective steel plates on the upper surfaces of the foot beams each have bent-down ends overlying the respective beam ends. Fasteners such as screws or nails are engaged through the steel-plate ends into the respective beam ends. Integral connections are provided between each of the plates and the annular stiffening rod at the lower edge of the wall. An inner vessel composed of flexible plastic material is enclosed by the outer wall and supported on the floor.

Typically the floor has a group of nine blocks in a rectangular array so that the pallet can be attacked from all four sides by a fork lift and each row of blocks is carried on a slat. The slats are in turn secured by the clips to the lower stiffening rod to hold the assembly together.

The problem with such an arrangement is that the container can lose shape either from rough handling, for instance being set down hard by a fork lift, or simply from the weight of the often heavy fluent contents of the bladder held in the outer vessel. The result is a container whose sides bulge out of the desired rectangular shape so it cannot be packed tight next to another such container or whose floor is downwardly deformed so that it cannot sit flat.

OBJECTS OF THE INVENTION

It is therefore an object of the present invention to provide an improved pallet-type container.

Another object is the provision of such an improved pallet-type container which overcomes the above-given disadvantages, that is which is stronger than the prior-art systems.

SUMMARY OF THE INVENTION

A storage/transport container has according to the invention an annular and erect outer wall in the form of a gridwork of metal rods having a lower edge and provided at the edge with an annular metal stiffening rod. A wooden floor-forming pallet downwardly closes the wall, forms with the wall an outer vessel, and has a ground-engaging lower surface, an opposite and horizontal upper surface, and a pair of vertical and generally parallel and longitudinally extending side edges. A metallic brace bar transversely bridges the pallet between its side edges, lies on the upper surface of the pallet, forms at each side edge a downwardly open notch engaging downwardly over the stiffening rod and has at each edge a downwardly extending tab formed outside the respective seat with a horizontally throughgoing hole. Respective metallic clips engage through the holes and under the lower stiffening rod and screws engaged vertically through the brace bar and clips into the pallet secure same together. An inner vessel composed of flexible plastic material is enclosed by the outer wall and supported on the floor.

Thus with this system any tendency of the floor region to spread, which is a particular problem with four-way pallets that are not transversely interconnected, is largely countered by the transverse brace bar. Thus spreading of the sides of the container is unlikely, even if it is handled roughly. The lower wall-reinforcing stiffening rod is captured in the ends of the brace bar so that it cannot deform in this region, and in fact the brace bar also transversely reinforces the wooden pallet. The stiffening rod is very effectively held and the parts holding it are mainly stressed in shear or tension as the inner vessel is filled, so that considerable force can be withstood.

According to the invention a plurality of such brace bars and clips can be provided parallel to each other spaced longitudinally along the pallet. Alternately the brace bar and clip are provided centrally in the pallet and the container further has end hold-down clamps engaged over the stiffening rod longitudinally offset from the brace bar and screws engage vertically through the clamps and into the pallet to secure same together.

The clips according to the invention each have a normally horizontal main part extending under the brace bar and formed with a hole through which the respective screw engages and a transversely extending normally vertical end part engaging flatly against the respective tab. Each screw engages through both the brace bar and a respective one of the clips.

The pallet in accordance with the invention is formed by a plurality of longitudinally extending wooden slats and a plurality of longitudinally spaced blocks on an underside of each of the slats. This design, a so-called four-way pallet, can be engaged at any side or end by a fork lift.

Each tab flatly engages the respective side edge and for maximum stability each clip is basically T-shaped and has a pair of arms lying flatly against the respective tab to each side of the respective hole.

BRIEF DESCRIPTION OF THE DRAWING

The above and other objects, features, and advantages will become more readily apparent from the following description, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing:

FIG. 3 is a small-scale horizontal section through an alternative container according to the invention;

FIG. 4 is a view like FIG. 3 showing the container of FIGS. 1 and 2;

FIG. 5 is a large-scale view of the detail indicated at V in FIG. 4; and FIG. 6 is an end view taken in the direction of arrow VI of FIG. 5.

SPECIFIC DESCRIPTION

Figure 1:
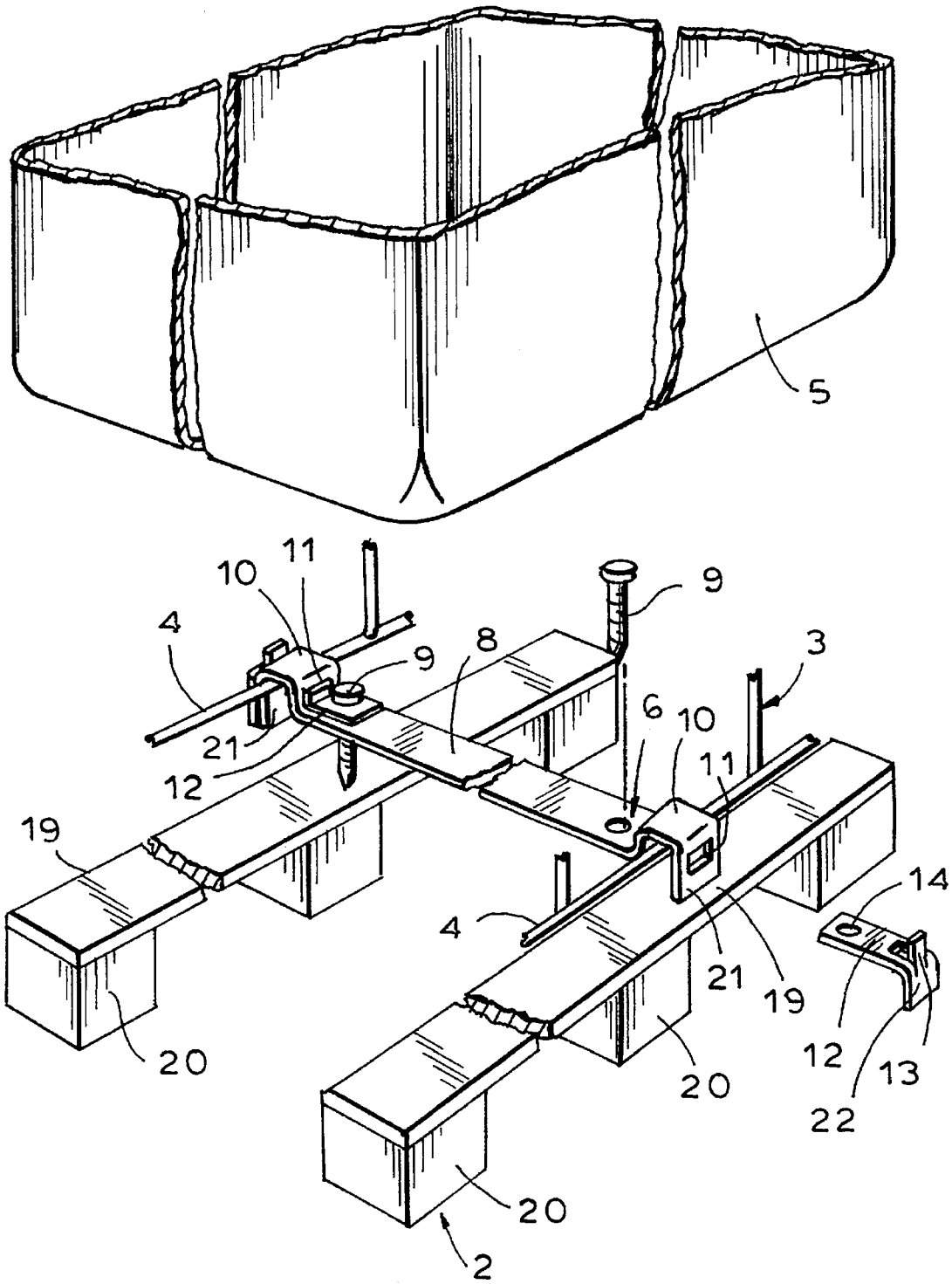
FIG. 1 is a small-scale perspective view of a container according to the invention.

As seen in FIG. 1 a storage/transport container 1 according to this invention intended to transport liquids and normally holding about 1 cubic meter basically comprises an annular gridwork wall 3 made of thin iron rods, of rectangular footprint, and having at its lower edge a thick annular stiffening rod 4 and at its upper edge another such stiffening rod 15. This wall 3 sits on a flat wooden pallet 2 forming a floor. A flexible plastic bag or inner vessel 5 held inside this wall 3 has an upper fill opening 16 and a lower drain opening 17. Braces 18 extend transversely across the top, attached to the upper rod 15.

Figure 2:
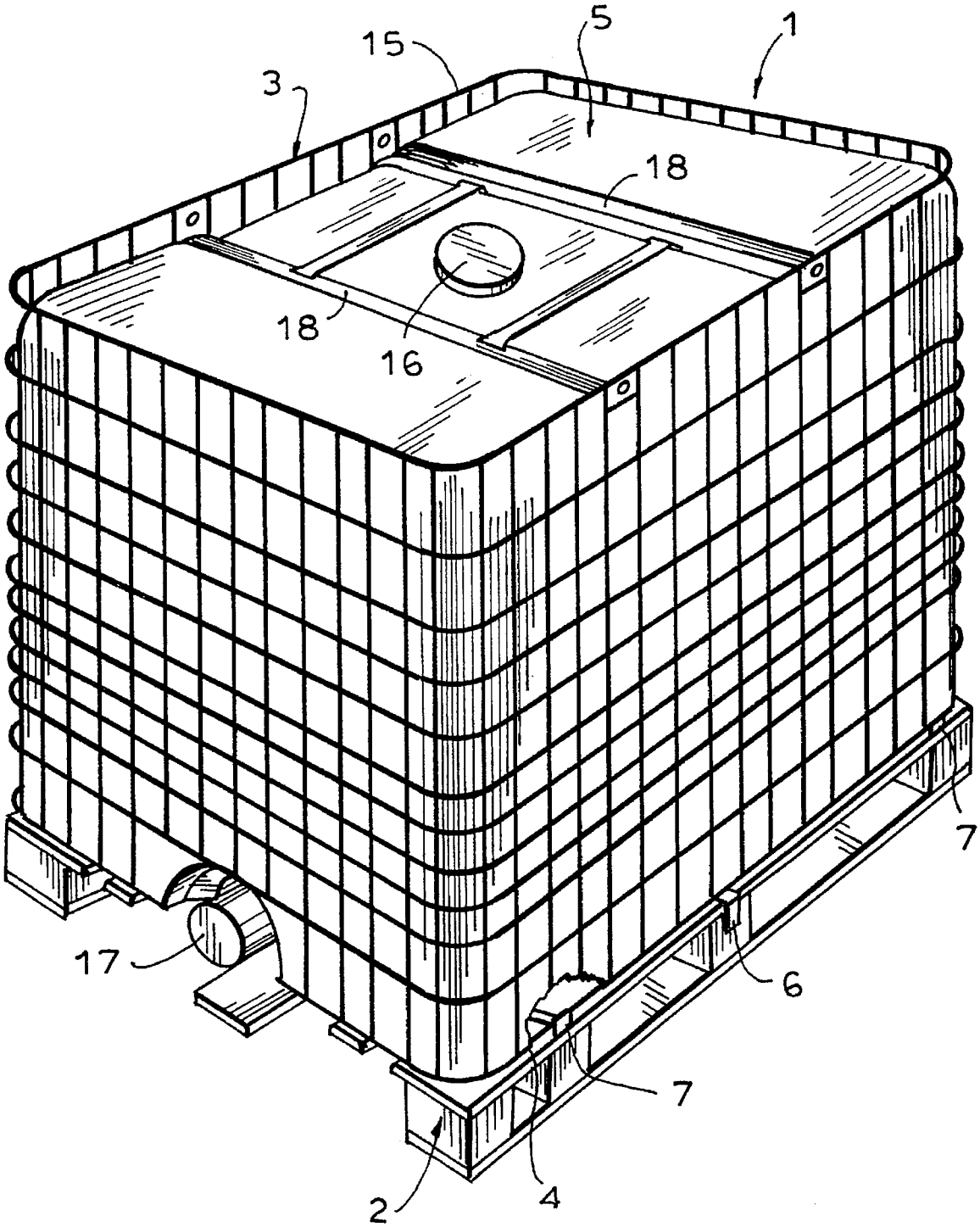
FIG. 2 is a larger-scale exploded view of a detail of the FIG. 1 container.

The pallet 2 as better seen in FIG. 2 comprises three (only two shown) parallel and longitudinally extending slats 19 to each of which are attached three longitudinally spaced blocks 20. At the center a brace bar 8 extends the full width of the pallet 2 between the opposite longitudinal side edges thereof. The bar 8, which is made of a piece of flat sheet steel, has at each end a downwardly U-shaped seat formation 10 that engages downwardly loosely over the rod 4, and a downwardly extending vertical tab 21 formed with a longitudinally extending throughgoing slot 11 and engaging a vertical outer side edge of the pallet 2. A bolt-like clip 12 projects through the slot 1 underneath the rod 4 and has a tab 22 that projects downward and another tab 13 that projects upward to limit entry of the clip 12. A hole 14 in the clip 12 aligns with a hole 6 in the bar 8 so that a screw 9 can engage through the holes 6 and 14 to lock the assembly together and to the wooden pallet 2.

Thus the brace bar 8 will prevent the center of the container 1 from bulging outward. The rods 4 are loosely but solidly captured in the seats 10 between the bar 8 and the clips 12 so that they cannot come loose, and the bar 8 is stressed substantially only in tension so it is very strong.

FIG. 3 shows how three such bars 8 can be used, one in the center, one at each end. FIG. 4 shows how only one such bar is used in the center and at the ends the wall 3 is secured down on the pallet 2 by J-shaped clamps 7 shown in more detail in FIGS. 5 and 6.

Such a container 1 can be made very economically and can be counted on the have a relatively long service life. It will not lose its shape readily so that it can be packed tightly with other such parallepipedal containers.

We claim:

1. A storage/transport container comprising:

an annular and erect outer wall in the form of a gridwork of metal rods having a lower edge and provided at the edge with an annular metal stiffening rod;

a wooden floor-forming pallet downwardly closing the wall, forming with the wall an outer vessel, and having a ground-engaging lower surface, an opposite and horizontal upper surface, and a pair of vertical and generally parallel and longitudinally extending side edges;

a metallic brace bar transversely bridging the pallet between its side edges, lying on the upper surface of the pallet, forming at each side edge a downwardly open notch seat engaging downwardly over the stiffening rod, and having at each edge a downwardly extending tab formed outside the respective seat with a horizontally throughgoing hole;

respective metallic clips engaging through the holes and under the stiffening rod;

screws engaged vertically through the brace bar and clips into the pallet securing same together; and an inner vessel composed of flexible plastic material enclosed by the outer wall and supported on the floor.

2. The storage/transport container defined in claim 1 wherein a plurality of such brace bars and clips are provided parallel to each other spaced longitudinally along the pallet.

3. The storage/transport container defined in claim 1 wherein the brace bar and clip are provided centrally in the pallet, the container further comprising:

end hold-down clamps engaged over the stiffening rod longitudinally offset from the brace bar; and screws engaged vertically through the clamps and into the pallet securing same together.

4. The storage/transport container defined in claim 1 wherein the clips each have a normally horizontal main part extending under the brace bar and formed with a hole through which the respective screw engages and a transversely extending normally vertical end part engaging flatly against the respective tab.

5. The storage/transport container defined in claim 1 wherein each screw engages through both the brace bar and a respective one of the clips.

6. The storage/transport container defined in claim 1 wherein the pallet includes a plurality of longitudinally extending wooden slats, and a plurality of longitudinally spaced blocks on an underside of each of the slats.

7. The storage/transport container defined in claim 1 wherein each tab flatly engages the respective side edge.

8. The storage/transport container defined in claim 7 wherein each clip is basically T-shaped and has a pair of arms lying flatly against the respective tab to each side of the respective hole.

9. The storage/transport container defined in claim 1 wherein the vessel is basically parallepipedal and has two long sides extending along the side edges.

* * * * *